US005129648A

United States Patent [19]

Sweeney et al.

[11] Patent Number: 5,129,648

[45] Date of Patent: Jul. 14, 1992

[54] BASKETBALL THROW SHOT PRACTICE ARRANGEMENT AND METHOD

[75] Inventors: Hugh W. Sweeney, P.O. Box 42238, Houston, Tex. 77242; Michael D. Wiseman, Cypress, Tex.

[73] Assignee: Hugh Sweeney, Houston, Tex.

[21] Appl. No.: 735,918

[22] Filed: Jul. 25, 1991

[51] Int. Cl.[5] ..... A63B 69/00

[52] U.S. Cl. ..... 273/1.5 A

[58] Field of Search ..... 273/1.5 R, 1.5 A, 395-397

[56] References Cited

U.S. PATENT DOCUMENTS

| | | | |
|---|---|---|---|
| 1,765,269 | 6/1930 | Hatley | 273/1.5 A |
| 3,233,896 | 2/1966 | King | 273/1.5 A |
| 3,901,506 | 8/1975 | Caveney | 273/1.5 A |
| 5,016,875 | 5/1991 | Joseph | 273/1.5 A |

FOREIGN PATENT DOCUMENTS

| | | | |
|---|---|---|---|
| 1319878 | 6/1987 | U.S.S.R. | 273/1.5 A |

OTHER PUBLICATIONS

Korney Board Aids, Basketball Coaching & Training Aids 1989 School Mail Order Catalog, Dec. 1988, p. 16, "Shot Shager".

*Primary Examiner*—Paul E. Shapiro

*Attorney, Agent, or Firm*—Jack W. Hayden

[57] ABSTRACT

A basketball throw arrangement includes a net supported by a longitudinally extending main support with lateral support arms engaging an upper edge of the net to position the net adjacent a basketball hoop on a backboard. The main support abuts the playing surface at its lower and the hoop and backboard adjacent its upper end. Support members of substantially less longitudinal extent than said main support engage the lower edge of the net and rest on the playing surface to position the net to form a trough that is inclined downwardly and forwardly from the upper net edge to the lower net edge to guide a basketball from the hoop or backboard toward the lower edge of the net for retrieval.

11 Claims, 3 Drawing Sheets

BASKETBALL THROW SHOT PRACTICE ARRANGEMENT AND METHOD

STATEMENT OF THE PRIOR ART

Applicant is not familiar with any prior art that discloses the structure, arrangement and advantages of the present invention.

SUMMARY OF THE INVENTION

Free throws as well as all other throws in a basketball game are significant, since the outcome of a number of games is determined by a few points difference between the winning and losing score. Heretofore, so far as known to applicant, free throws as well as other throw attempts have been practiced by a player standing at the free throw line or at various other locations on the playing surface and throwing the basketball toward the basket and then chasing the ball to retrieve it, or having one or more other players, or assistants positioned to catch, or retrieve the ball and then throwing it to the player practicing free throw shots.

This requires the involvement of a number of players, or extra help, as well as decreasing the time that a player can actually spend in throwing a basketball toward a hoop supported on a backboard.

An object of the present invention is to provide a net arrangement which can be readily and easily positioned adjacent the backboard and hoop and maintained in position to enable a person to practice free throws and other throws by himself without the assistance of other players or extra help to retrieve the basketball.

Yet a further object of the present invention is to provide an arrangement to guide a basketball from a backboard on which a hoop is supported back toward a player practicing throws at the free throw line or elsewhere.

Yet a further object of the present invention is to provide a method of easily assembling an arrangement including a main support, having an upper and a lower end for positioning the lower end on the playing surface and the upper end abutting the backboard and basketball hoop supported thereon, the main support having support arms extending laterally therefrom to support the upper edge of the net and maintain it elevated in a trough like relationship to guide the basketball from the hoop or the backboard downwardly and forwardly to adjacent the lower edge of the net which is supported by support members at a much lower elevation than the upper edge of the net to accomplish the desired trough like shape of the net.

Yet a further object of the present invention is to provide a main support for a basketball throw practice arrangement which may be adjusted vertically to secure the lower end of the main support on the playing surface and the upper end in a fixed or abutting relationship to the hoop and backboard by supporting a net extending laterally from each side of the main support and extending upwardly on each side from the main support and the arrangement having support members engaging the lower edge of the net with the main support having a longitudinal extent much greater than the support members so that the net is inclined downwardly and forwardly towards the playing surface to guide the basketball from the backboard or the hoop back toward the player adjacent the lower edge of the net.

Other objects and advantages of the present invention will become more readily apparent from the present description and drawings.

DESCRIPTION OF THE PREFERRED EMBODIMENTS

The present invention is described specifically as it applies to free throw shots, but it can be appreciated that it can be used for practicing shots anywhere on the playing surface and still return the ball toward the lower edge of the net rather than having the basketball bounce off the board or hoop toward various locations on the playing surface requiring that it retrieved at such locations before another practice throw is attempted.

Figure 1:
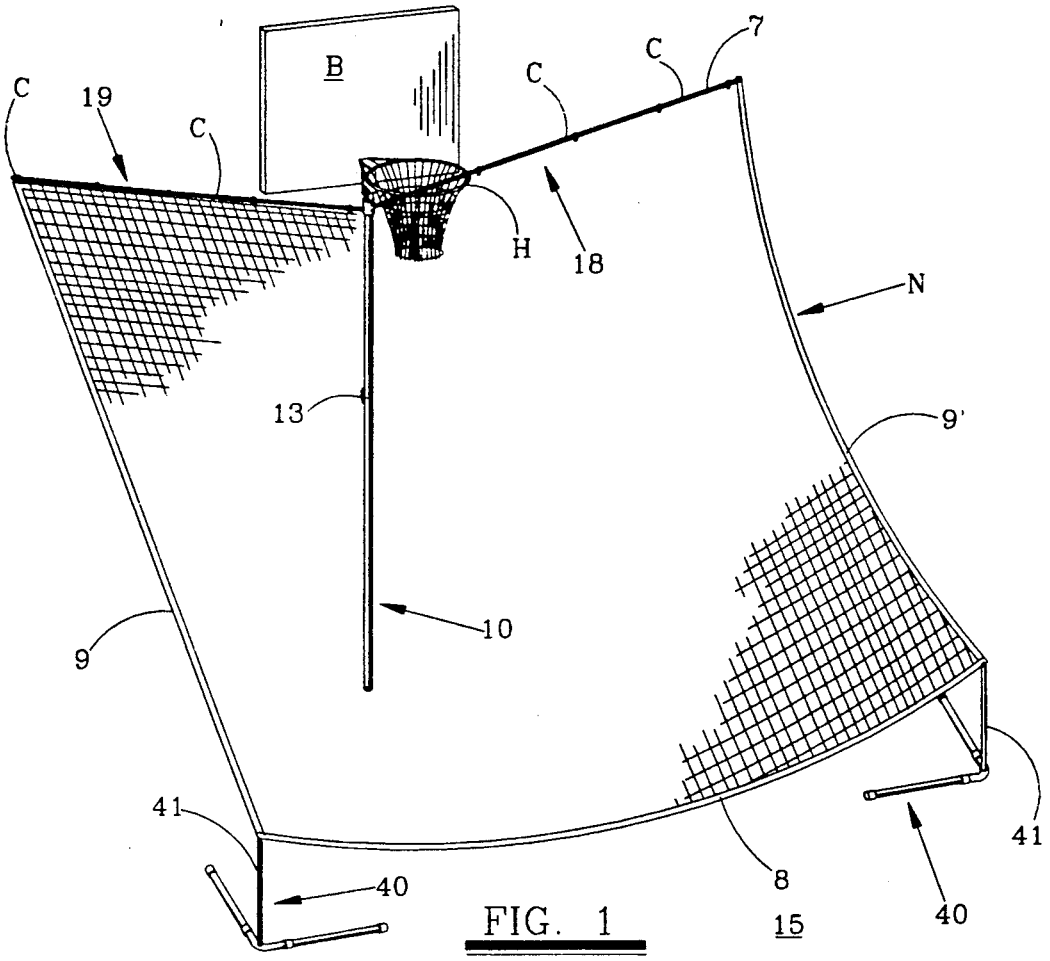
FIG. 1 is a perspective view of a preferred embodiment of the arrangement of the present invention with the main support shown schematically.
Figure 3:
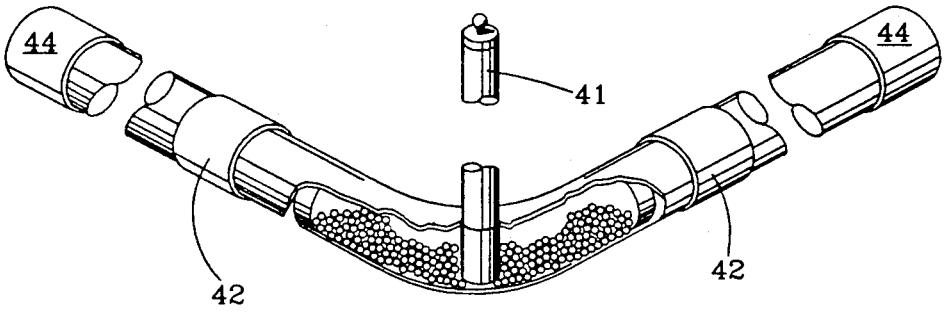
FIG. 3 is a perspective view illustrating one form of the support members and for providing weight if such weight is desired or needed to maintain the support members in position on the playing surface and engaged with the lower edge of the net to maintain the net in inclined position as illustrated in FIG. 1.

Attention is first directed to FIG. 1 of the drawings wherein a net is referred to generally by the letter N. The net has an upper edge 7 and a lower edge 8, and in the embodiment illustrated in the drawings is generally rectangular providing side edges 9 and 9'. It can be appreciated that the exact configuration and shape of the net N may be changed without departing from the scope of the present invention.

We have determined that a suitable size of the net is 20 feet wide at its upper edge 7 and 15 feet in extent along the edges 9 and 9'. This provides a net which spans or extends ten feet on each side of the main support 10. Also, the lower edge 8 of the net may be 20 feet in extent. This shape, as noted above, may be varied or changed, but the foregoing sizes have been found to work quite satisfactorily. The net size and arrangement may be varied as desired to generally guide the basketball to the lower net edge on the playing surface where desired.

Figure 2:
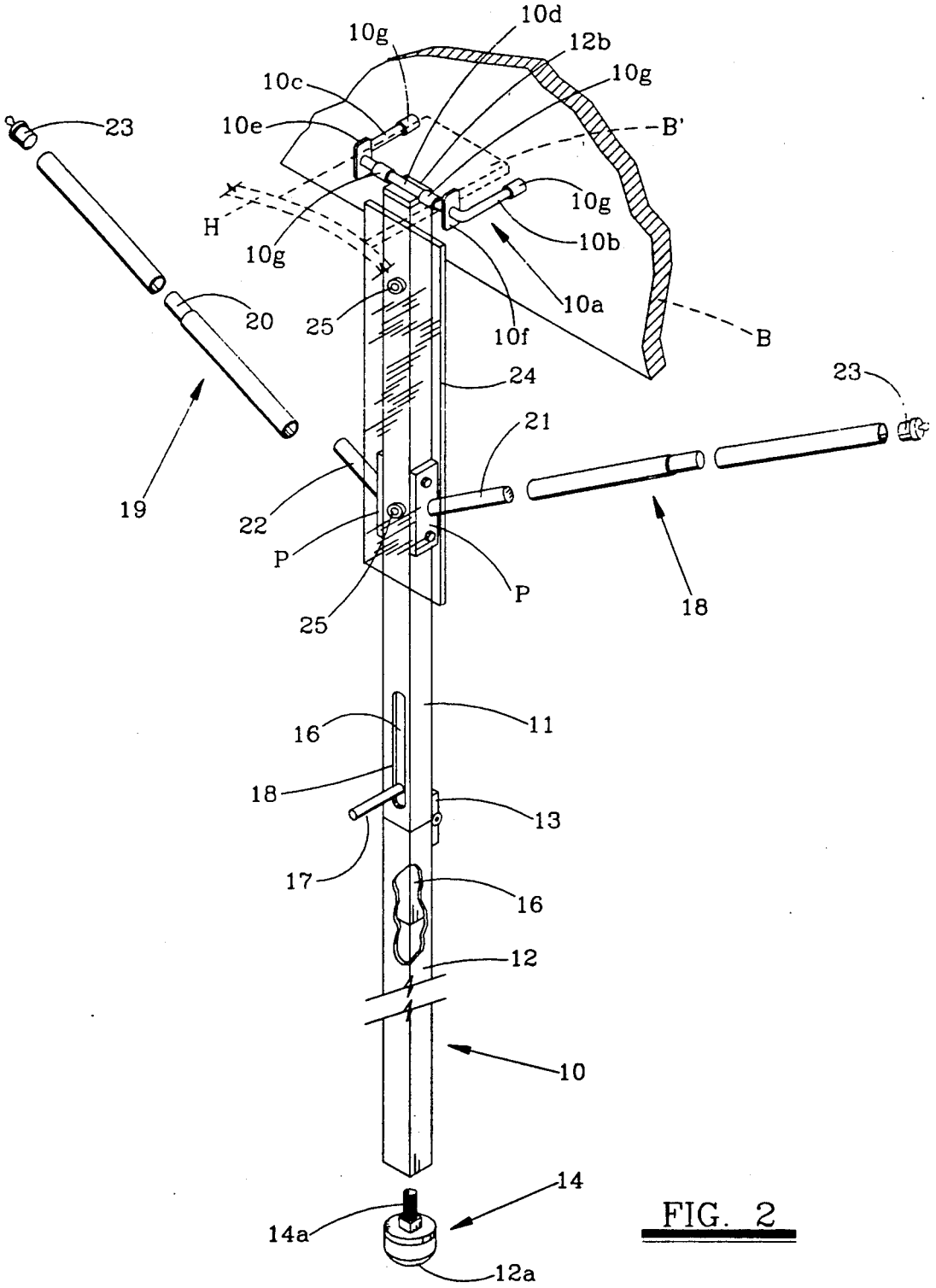
FIG. 2 is an elevational detail view of a form of the main support and support arms extending laterally and upwardly therefrom adjacent the hoop and basketball backboard, with the support arms partly exploded and a form of means for increasing the longitudinal extent of the main support.

The main support is referred to generally by the numeral 10 in FIG. 2 and is shown as including two hollow rectangular tubular portions 11 and 12. It can be appreciated that the number of hollow portions may vary, and the shape of the hollow portions 11 and 12 may also vary. The main support 10, support arms 18,19 and support members 40 may be formed of any suitable material such as metal or plastic. The main support 10 should be of suitable length or extent so that when in position between the hoop H supported on the backboard B in elevated relation to a playing surface represented at 15, it will be firmly secured by its lower end 12*a* resting on the playing surface 15 and by its upper end 12*b* in abutting relationship preferably with the backboard and the hoop, or at least one of them. It is also desirable that suitable means be provided to enable the longitudinal extent of the main support to be adjusted to accomplish the foregoing relationship.

One form of suitable means may be that as represented by the numeral 14, as described hereinafter, so that the longitudinal extent of the main support 10 can be varied within limits to assure that it can be firmly positioned on the playing surface at its lower end 12*a* and firmly abutted against the backboard and/or hoop adjacent its upper end 12*b*.

Also it will be noted that in the FIG. 2 embodiment, the hollow portions 11 and 12 forming the main support are illustrated as being secured together by suitable hinge means 13 to enable the longitudinal extending main support 10 to be folded to make it easier to ship. Means are provided to secure the embodiment shown in FIG. 2 so that the hollow portions 11 and 12 remain engaged when positioned adjacent the backboard and hoop, such means including a slideable member 16 which slideably fits within the upper hollow member 11 as shown. The slideable member includes an extension 17 projecting through a longitudinal slot 18 formed in the upper member 11. When the main support 10 is to be positioned for use, the upper and lower hollow members 11 and 12 will be aligned as shown in the drawings and then the slideable member 16 will slide downwardly, due to its own weight, in the slot to the position shown in FIG. 2 so that it extends into the lower member 12 shown in FIG. 2 of the drawing to secure them together to form the main support 10.

Support arms referenced generally by the numerals 18 and 19 are provided for removably engaging with any suitable hooks, clamps or other means as represented schematically at C in FIG. 1 and suitably spaced along support arms 18 and 19 for engagement with the upper edge 7 of the net to retain the upper edge 7 of the net engaged with the support arms 18 and 19 in elevated position adjacent the backboard as illustrated in FIG. 1 of the drawing.

The support arms may be formed in any suitable manner, but are preferably formed in a manner so that the present arrangement may be packaged for shipment. If the support arms are formed of a plurality of members, then such members may be tubular and provided with a suitable configuration such as that illustrated at 20 adjacent their ends to enable the portions forming the support arms to be telescopically engaged with suitably sized adjacent portions to fit together to form a support arm of desired length. As previously noted, the width of the upper edge 7 of the net as described hereinbefore is 20 feet. Thus, each support arm 18 and 19 would be 10 feet in length.

Also, it is preferable that two laterally extending support arm portions 21 and 22 be provided for securing on opposite sides of the main support 10 to extend laterally therefrom as shown in the drawings. It is also preferred that such portions 21 and 22 extend laterally and not only in opposed directions, but extend upwardly relative to the longitudinal axis of the main support 10 as represented in FIG. 2 of the drawings so that when the portions 20 forming each support arm are connected together and positioned on 21 and 22, the support arms 18 and 19 will extend preferably upwardly and outwardly relative to the longitudinal axis of support 10 and in opposed relationship from the support arm 10 as shown in FIGS. 1 and 2 of the drawings. The portions 21,22 may be secured to a plate P by suitable means such as welding or the like so they will assume the desired upward and outward relationship to main support 10 when the plates P are secured to support 10 by screws or the like as shown in the drawings.

It can be appreciated that any suitable means for connecting the portions together may be provided to form the support arms 18 and 19 and the above is described as a preferred embodiment. Also suitable plug means as shown at 23 may be positioned in the ends of the support arms, if desired.

A member 24 of greater lateral extent than the main support 10 may be secured to the main support 10 to extend upwardly from adjacent the support arms 18 and 19 to adjacent the upper end 12*b* of the main support 10 to provide a deflection means for basketballs that go beneath the hoop and do not hit the backboard. The member 24 may be formed of any suitable material such as plastic or metal and may be secured to the support 10 by any suitable means such as the bolts 25.

Figure 4:
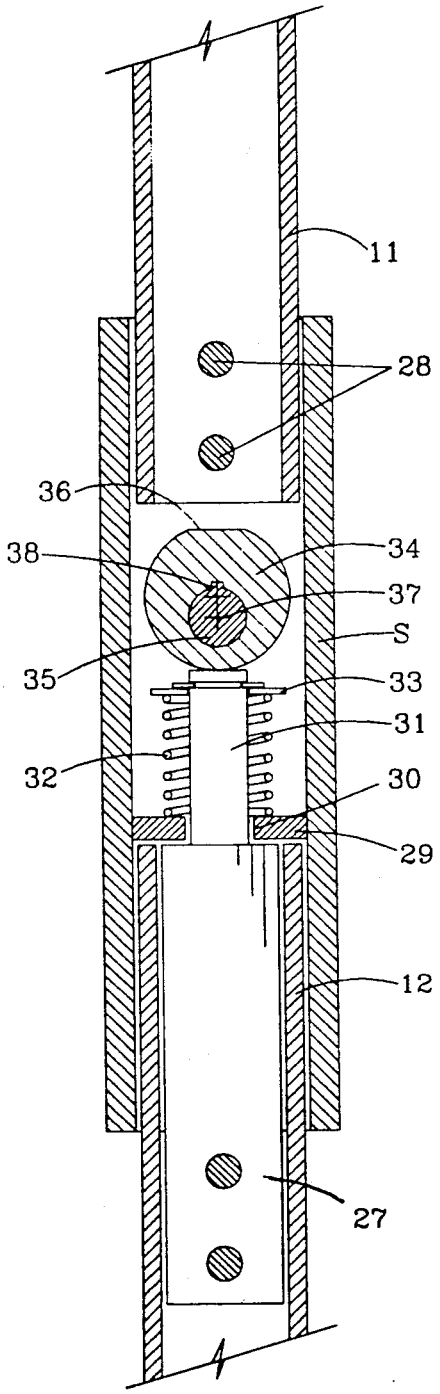
FIG. 4 is a sectional view illustrating an alternate embodiment for securing together the portions which constitute the main support, and another embodiment which enables the main support to be adjusted longitudinally to increase its longitudinal extent.
Figure 5:
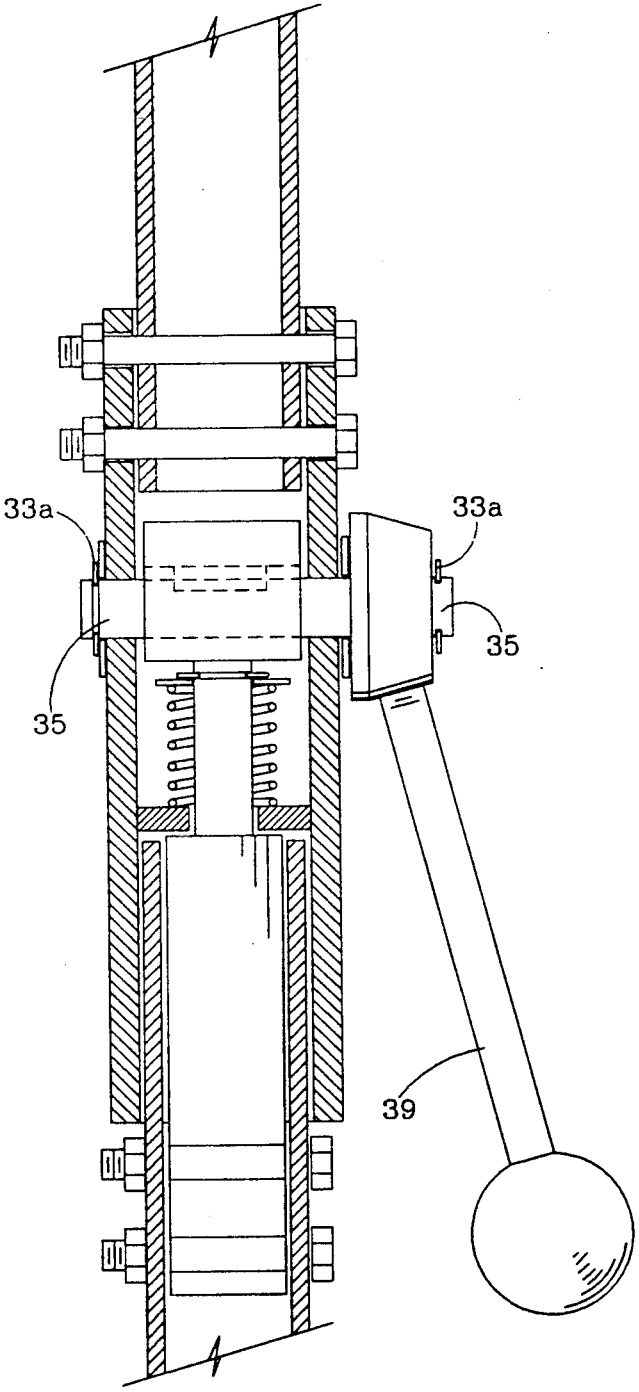
FIG. 5 is a view similar to FIG. 4 but rotated 90 degrees.

Another embodiment for increasing the longitudinal extent of the main support 10 is shown in FIGS. 4 and 5. In this form, the member 11 is secured by suitable means such as bolts 28 to a sleeve S. The sleeve extends longitudinally as shown and telescopically receives the adjacent end of member 12 as shown. A plunger 27 is secured to the member 12 adjacent the end received in the sleeve S and extends longitudinally as shown to be received telescopically along with the member 12 in the sleeve S. A barrier forming a stop 29 in the sleeve S is in spaced relation to the end of member 11 as shown and is provided with an opening 30. The end of member 12 and the adjacent end of plunger 27 are adjacent the stop 29, Extension 31 on plunger 27 is received through the opening 30. A spring 32 has its lower end resting on the upper surface of stop 29 and its upper end abuts a retainer clip 33 engaged in a groove in cylindrical extension 31 adjacent its upper end. A cylindrical rotatable member 34 is mounted on rotator 35 and member 34 is in abutting relationship with the upper end of extension 31 as shown in FIG. 4.

Member 34 is provided with a flat surface 36 that is spaced 180 degrees from the contact of member 34 with extension 31. The rotator is a shaft that extends through the sleeve S and member 33. It extends longitudinal off center relative to the longitudinal axis 37 of member 34 as shown in the drawings. Member 34 and rotator 35 are secured to rotate together by any suitable means such as the key and slot arrangement shown. The axis of rotation, represented at 37, of connected rotator 35 and member 34 is offset, as shown, relative to the axis, represented at 38, of member 34. Thus when actuator arm 39 connected on rotator 35 is rotated, member 34 and rotator 35 rotate to move 34 and 34 compresses spring 31 until surface 34 engages with the end of extension 31. This pushes extension 31, plunger 27 and lower portion 12 of main support 10 downwardly which increases the length of main support 10.

Rotator 35 is connected to sleeve S and actuator 39 by any suitable means such as the clips 33*a* and groove arrangements shown.

Member 14 includes the threaded extension 14*a* which threadedly engages in the lower end of support 10, and when it is partially unscrewed, it also will increase the length of the support 10 so it can be firmly secured between the playing surface 15 and the hoop and backboard.

Support members referred to generally at 40 are provided to engage the lower edge 8 of the net. The members 40 include a vertical member 41 connected to lateral extensions 42 which rest on the playing surface 15. If desired suitable weights may be employed with members 40, and one suitable means is to use lead shot in the tubular members 42 along with a suitable solidifying polymer and end caps 44 may be employed on the ends of the tubular members 42.

One suitable length of the support 10 is 10 feet and a suitable length of the support members for the lower edge is about 3 feet. Thus, the support members 40 are of much less longitudinal extent than the support 10 and aid in positioning the net so that it is inclined forwardly of the support 10 and downwardly towards the free throw line.

The net N by reason of the arrangement of the upwardly and outwardly extending support arms 18 and 19 in cooperation with the natural sagging of the net between the upper and lower edges and between the support members 40 preferably secured at each corner of the lower edge 8 forms a general trough arrangement to aid in guiding the basketball from the backboard or the hoop back to the player adjacent the free throw line.

The upper end of the main support 10 includes a generally U-shaped arrangement referenced generally by numeral 10*a* and includes arms 10*b* and 10*c* with the base 10*d* extending there between. The base 10*d* is secured to the upper end 12*b* of the main support 10 as illustrated in the drawings and if desired additional positioning members 10*e* and 10*f* may be provided. The base member 10*d* is intended to engage the bottom of the bracket B' which may form part of the hoop H secured to the backboard B to hold the hoop H in position. If desired friction elements or members 10*g* of suitable material may be positioned on the end of the members 10*b* and 10*c* and on the base 10*d* to assist in retaining the main support 10 in engagement with the bracket B' and backboard B. Suitable friction material may be provided on the lower end of member 14 which forms the lower end of support 10, or on the lower end 12*a* of support 10 when the form of FIGS. 4 and 5 is employed.

In use of the present invention, it is intended that it normally would be shipped in disassembled relationship and the main support 10 is formed by manipulating the members 11 and 12 to the position in FIG. 2, if that embodiment is employed. Thereafter the plunger 16 is dropped to secure them together and the support arms 18 and 19 formed by either two single 10-foot members secured to each of the elements 21 and 22 and the upper edge 7 of the net secured thereto by suitable removable clip means as illustrated schematically as heretofore described. Thereafter the net and support 10 may be positioned adjacent the backboard and in engagement with the bracket B' of the hoop H and the backboard with the lower end 12*a* adjusted to maintain the support 10 in position. Thereafter the lower edge support means 40 are connected to the net either at the corner, or another desired position to maintain the net so that it is inclined forwardly and downwardly from adjacent the backboard to adjacent the free throw position on the playing surface.

The foregoing disclosure and description of the invention are illustrative and explanatory thereof and various changes in size, shape and materials as well as in the details of the illustrated construction may be made without departing from the spirit of the invention.

What is claimed is:

1. A basketball throw practice arrangement for use adjacent a backboard that supports a basketball hoop in elevated position in relation to a playing surface, said arrangement comprising:

a net having upper and lower edges;

a main support for said net, said main support having a lower end to rest on the playing surface and an upper end to abut against the hoop and backboard;

support arms for engaging with said main support adjacent the upper end of said main support, said support arms extending in opposite directions from adjacent the upper end of said main support for engaging and supporting the upper edge of said net; and support members for resting on the playing surface in forwardly spaced relation to said backboard and for engaging said net adjacent the lower edge thereof to assist in positioning said net in a downwardly and forwardly inclined relation from the upper to the lower edge of the net to guide a basketball from the backboard or hoop to the lower edge of the net for retrieval.

2. The arrangement of claim 1 wherein said net is rectangular in shape.

3. The arrangement of claim 1 wherein said main support includes:

two hollow end portions;

hinge means connecting said two hollow end portions together in end to end relation to form said main support;

one of said members having a slot therein;

a slidable member in said one member; and a lateral extension on said slidable member, said extension projecting through said slot whereby said slidable member may be positioned to extend between said two hollow end portions to form said main support.

4. The arrangement of claim 1 wherein said main support includes two hollow end portions in end to end relation and adjustable means to adjust the longitudinal extent of said main support to retain it in position between the hoop and the playing surface.

5. The arrangement of claim 4 wherein said adjustable means includes a member adjustably secured to the lower end of said main support which may be adjusted to increase the longitudinal extent of said main support.

6. The arrangement of claim 4 wherein said adjustable means for said main support includes:

a sleeve secured to one of said hollow end portions and extending therefrom;

a member secured within the other of said hollow end portions;

a longitudinal extension on said member, said extension extending beyond the end of said other hollow end portion;

said sleeve telescopically receiving the other of said hollow end portions and said member secured therein;

a stop within said sleeve, said stop having an opening therein for receiving said longitudinal extension therethrough;

a spring for surrounding said extension and having one end for resting on said stop;

said spring having an outer end;

a retainer for removably securing on said extension and abutting said outer end of said spring to retain said spring in position on said extension;

a rotatable cylindrical member abutting the end of said extension;

a rotator extending through said sleeve and said rotatable cylindrical member to rotate said rotatable cylindrical member;

said rotator having an axis of rotation which is offset relative to the axis of rotation of said cylindrical member;

actuator means connected with said rotator to rotate said rotatable cylindrical member;

said rotatable cylindrical member having a flat surface thereon for engaging said extension when said actuator rotates said rotatable cylindrical member to depress said spring and move said member and said other hollow end portion longitudinally relative said sleeve to increase the longitudinal extent of said main support.

7. The arrangement of claim 1 wherein said support members which engage with the lower edge of said net rest on the playing surface in spaced relation forwardly from said main support and backboard, said support members having a vertical longitudinal extent which is substantially less than the longitudinal extent of said main support; and said support members having laterally extending portions to rest on the playing surface so that when said net upper edge is in position adjacent said backboard and supported by said main support and said support arms, said net is inclined downwardly and forwardly from its upper edge to its lower edge to form a trough to guide a basketball from the hoop or backboard toward the lower net edge for retrieval.

8. The arrangement of claim 1 wherein said main support is provided adjacent its upper end with a generally U shaped portion extending in a plane laterally and rearwardly relative to said main support and net for engaging the hoop and backboard to aid in retaining said main support in position abutted between the playing surface and the hoop and backboard.

9. The arrangement of claim 1 wherein said support arms also extend upwardly from said main support to assist in forming a trough to guide the basketball to the lower net edge.

10. The arrangement of claim 1 including an additional member of greater lateral extent than said main support and secured to said main support to extend upwardly therefrom to adjacent the hoop to deflect basketballs which pass beneath the hoop back onto the net.

11. A method of positioning a net to guide a basketball toward the lower edge of the net for retrieval by a player practicing throw shots on a playing surface wherein a hoop is supported on a backboard in elevated position and a net having upper and lower edges is positioned by a main support having an upper and a lower end, support arms extending laterally from the main support adjacent the upper edge of the net and the upper end of the main support and net lower edge support members of substantially less longitudinal extent than the main support for engaging with the lower net edge comprising the steps of:

securing the support arms adjacent the upper end of the main support to extend laterally from each side of the main support in opposed directions;

securing the upper edge of the net with the support arms;

securing the upper end of the main support in abutting relation with the hoop and backboard and its lower end in abutting relation with the playing surface;

engaging the net lower edge support members with the lower net edge; and positioning the lower edge support members and lower net edge engaged therewith forwardly of the main support location so that the net forms a trough to guide the basketball from the hoop or backboard back toward the lower edge of the net for retrieval.

* * * * *